US009197336B2

(12) United States Patent
Sigal et al.

(10) Patent No.: US 9,197,336 B2
(45) Date of Patent: Nov. 24, 2015

(54) SYSTEM AND METHOD FOR PROVIDING CUSTOMIZED AUDIO CONTENT TO A VEHICLE RADIO SYSTEM USING A SMARTPHONE

(71) Applicant: Myine Electronics, Inc., Ferndale, MI (US)

(72) Inventors: Jacob R. Sigal, Ferndale, MI (US); Massimo Baldini, Beverly Hills, MI (US)

(73) Assignee: MYINE ELECTRONICS, INC., Ferndale, MI (US)

( * ) Notice: Subject to any disclaimer, the term of this patent is extended or adjusted under 35 U.S.C. 154(b) by 0 days.

(21) Appl. No.: 14/246,693

(22) Filed: Apr. 7, 2014

(65) Prior Publication Data

US 2014/0336875 A1 Nov. 13, 2014

Related U.S. Application Data

(60) Provisional application No. 61/820,920, filed on May 8, 2013.

(51) Int. Cl.
*H04H 20/62* (2008.01)
*H04H 60/85* (2008.01)

(52) U.S. Cl.
CPC ..... *H04H 20/62* (2013.01); *H04H 60/85* (2013.01)

(58) Field of Classification Search
CPC ..... H04H 20/62; H04H 60/85
USPC ..... 701/36
See application file for complete search history.

(56) References Cited

U.S. PATENT DOCUMENTS

| | | | |
|---|---|---|---|
| 6,366,202 | B1 | 4/2002 | Rosenthal |
| 6,526,335 | B1 | 2/2003 | Treyz et al. |
| 6,573,833 | B1 | 6/2003 | Rosenthal |
| 7,047,117 | B2 | 5/2006 | Akiyama et al. |
| 7,207,041 | B2 | 4/2007 | Elson et al. |
| 7,266,435 | B2 | 9/2007 | Wang et al. |
| 7,505,784 | B2 | 3/2009 | Barbera |
| 7,602,782 | B2 | 10/2009 | Doviak et al. |
| 7,650,864 | B2 | 1/2010 | Hassan et al. |

(Continued)

OTHER PUBLICATIONS

Whitfield, "A hitchhiker's guide to the telematics ecosystem", Automotive Design & Production, Oct. 2003, http://findarticles.com, pp. 1-3.

(Continued)

*Primary Examiner* — Fadey Jabr
*Assistant Examiner* — Aaron L Troost
(74) *Attorney, Agent, or Firm* — Harness, Dickey & Pierce, P.L.C.

(57) ABSTRACT

A method is disclosed for providing real time information content from a remote content source to an individual travelling in a vehicle over a personal electronic device (PED) of the individual, for playback over a subsystem of the vehicle. A control is designated on the vehicle subsystem which enables the individual to request the information content from the remote content source. A short range wireless link is established between the user's PED and the vehicle subsystem and the PED is used to access the information content from at least one Cloud based information service. The information content is then streamed back to the vehicle subsystem over the PED and played back to the individual, at least substantially in real time, while the individual is traveling in the vehicle.

16 Claims, 2 Drawing Sheets

(56) References Cited

U.S. PATENT DOCUMENTS

| | | | | |
|---|---|---|---|---|
| 7,801,941 | B2 | 9/2010 | Conneely et al. | |
| 7,996,228 | B2 | 8/2011 | Miller et al. | |
| 8,121,802 | B2 | 2/2012 | Grider et al. | |
| 8,131,458 | B1 | 3/2012 | Zilka | |
| 8,942,888 | B2 * | 1/2015 | Garrett et al. | 701/36 |
| 2002/0098853 | A1 | 7/2002 | Chrumka | |
| 2002/0103715 | A1 | 8/2002 | Bennett et al. | |
| 2002/0107010 | A1 | 8/2002 | Witte et al. | |
| 2003/0079123 | A1 | 4/2003 | Mas Ribes | |
| 2003/0139179 | A1 | 7/2003 | Fuchs et al. | |
| 2003/0147534 | A1 | 8/2003 | Ablay et al. | |
| 2004/0203660 | A1 | 10/2004 | Tibrewal et al. | |
| 2004/0205216 | A1 | 10/2004 | Ballinger et al. | |
| 2004/0260438 | A1 | 12/2004 | Chernetsky et al. | |
| 2004/0267585 | A1 | 12/2004 | Anderson et al. | |
| 2005/0091408 | A1 | 4/2005 | Parupudi et al. | |
| 2005/0177635 | A1 | 8/2005 | Schmidt et al. | |
| 2005/0225175 | A1 | 10/2005 | Maehara et al. | |
| 2006/0009213 | A1 * | 1/2006 | Sturniolo et al. | 455/426.1 |
| 2006/0150197 | A1 | 7/2006 | Werner | |
| 2006/0156315 | A1 | 7/2006 | Wood et al. | |
| 2006/0190097 | A1 | 8/2006 | Rubenstein | |
| 2006/0206340 | A1 | 9/2006 | Silvera et al. | |
| 2006/0271246 | A1 | 11/2006 | Bell et al. | |
| 2006/0287787 | A1 | 12/2006 | Engstrom et al. | |
| 2006/0287821 | A1 | 12/2006 | Lin | |
| 2007/0016362 | A1 | 1/2007 | Nelson | |
| 2007/0042809 | A1 | 2/2007 | Angelhag | |
| 2007/0042812 | A1 | 2/2007 | Basir | |
| 2007/0050854 | A1 | 3/2007 | Cooperstein et al. | |
| 2007/0132572 | A1 | 6/2007 | Itoh et al. | |
| 2007/0140187 | A1 | 6/2007 | Rokusek et al. | |
| 2007/0294625 | A1 | 12/2007 | Rasin et al. | |
| 2008/0086455 | A1 | 4/2008 | Meisels et al. | |
| 2008/0117079 | A1 | 5/2008 | Hassan | |
| 2008/0148374 | A1 | 6/2008 | Spaur et al. | |
| 2008/0220718 | A1 | 9/2008 | Sakamoto et al. | |
| 2008/0313050 | A1 | 12/2008 | Basir | |
| 2009/0010448 | A1 | 1/2009 | Voto et al. | |
| 2009/0075624 | A1 | 3/2009 | Cox et al. | |
| 2009/0106036 | A1 | 4/2009 | Tamura et al. | |
| 2009/0117890 | A1 | 5/2009 | Jacobsen et al. | |
| 2009/0140064 | A1 | 6/2009 | Schultz et al. | |
| 2009/0156182 | A1 | 6/2009 | Jenkins et al. | |
| 2009/0228908 | A1 | 9/2009 | Margis et al. | |
| 2009/0253466 | A1 | 10/2009 | Saito et al. | |
| 2009/0318119 | A1 | 12/2009 | Basir et al. | |
| 2010/0063670 | A1 | 3/2010 | Brzezinski et al. | |
| 2010/0094996 | A1 | 4/2010 | Samaha | |
| 2010/0098853 | A1 | 4/2010 | Hoffmann et al. | |
| 2010/0131642 | A1 | 5/2010 | Chalikouras et al. | |
| 2010/0157061 | A1 | 6/2010 | Katsman et al. | |
| 2010/0216509 | A1 | 8/2010 | Riemer et al. | |
| 2010/0234071 | A1 | 9/2010 | Shabtay et al. | |
| 2010/0306309 | A1 | 12/2010 | Santori et al. | |
| 2010/0332988 | A1 * | 12/2010 | Fong et al. | 715/727 |
| 2011/0043599 | A1 | 2/2011 | Luo et al. | |
| 2011/0074561 | A1 | 3/2011 | Mackjust et al. | |
| 2011/0087385 | A1 | 4/2011 | Bowden et al. | |
| 2011/0105097 | A1 | 5/2011 | Tadayon et al. | |
| 2011/0110530 | A1 | 5/2011 | Kimura | |
| 2011/0112762 | A1 | 5/2011 | Gruijters et al. | |
| 2011/0185390 | A1 | 7/2011 | Faenger et al. | |
| 2011/0195659 | A1 | 8/2011 | Boll et al. | |
| 2011/0275358 | A1 | 11/2011 | Faenger | |
| 2011/0296037 | A1 | 12/2011 | Westra et al. | |
| 2012/0054300 | A1 | 3/2012 | Marchwicki et al. | |
| 2012/0064917 | A1 | 3/2012 | Jenkins et al. | |
| 2012/0065815 | A1 | 3/2012 | Hess | |
| 2012/0079002 | A1 | 3/2012 | Boll et al. | |
| 2012/0084292 | A1 | 4/2012 | Liang et al. | |
| 2012/0259951 | A1 * | 10/2012 | Schalk et al. | 709/217 |
| 2013/0311036 | A1 * | 11/2013 | Liu et al. | 701/36 |

OTHER PUBLICATIONS

Goodwin, The Car Tech Blog, Ford Unveils open-source Sync developer platform, http://reviews.cnet.com/8301-13746_7-10385619-48.html, Oct. 2009, pp. 1-5.

Chantry, MSDN, Mapping Application to the Cloud, 2010 Microsoft Corporation, Platform Architecture Team, Jan. 2009, http://msdn.microsoft.com/en-us/library/dd430340(printer). aspx, Jun. 18, 2010.

European Patent Office, Extended Search Report for corresponding European Patent Application No. 11151623.3-1244 mailed Mar. 11, 2011.

Gil-Castineira, et al., Integration of Nomadic Devices with Automotive User Interfaces, IEEE Transactions on Consumer Electronics, vol. 55, No. 1, Feb. 2009.

"How PhonEnforcer Works" Turn Off the Cellphone While Driving-PhoneEnforcer. Turn Off The Cell Phone LLC. <http://turnoffthecellphone.comm/hotitworks.htm> Dec. 28, 2010, pp. 1-3.

"PhoneEnforcer FAQ's" Turn Off the Cellphone While Driving—PhneEnforcer. Turn Off The Cell Phone LLC. <http://turnoffthecellphone.com/faq.html> Dec. 28, 2010, pp. 1-2.

"MobileSafer is your personal safe driving assistant," 2010 ZoomSafer Inc. <http://zoomsafer.com/products/mobilesafer> Dec. 28, 2010.

IPhone Hacks, Apple Files Patent Which Allow You to Control Your Computer Remotely Using IPhone.http://www.iphonehacks.com/2009/12/apple-files-patent-which-could-allow-you-to-control-your-computer-remotely-using-iphone, Jun. 22, 2010.

International Searching Authority, Korean Intellectual Property Office, International Search Report for PCT Application No. PCT/US2011/053342 mailed Apr. 19, 2012.

Narasimhan, et al., A lightweight remote display management protocol for mobile devices, Application Research Center, Motorola Labs Schaumburg, IL, 2007, pp. 711-715.

Nusser, et al., Bluetooth-based Wireless Connectivity in an Automotive Environment, Robert Bosch GmbH, VTC 2000, pp. 1935-1942.

Lamberti, Ralph, "Daimler Full Circle: The Rise of Vehicle-Installed Telematics—Telematics Munich 2009" Nov. 10, 2009.

Service Discovery Protocol (SDP) Layer Tutorial, Palowireless Bluetooth Research Center, http://www.palowireless.com/infotooth/tutorial/sdp.asp. Aug. 3, 2010.

Ford Motor Company, "Navigation System: SYNC," Owner's Guide Supplement, SYNC Version 1 (Jul. 2007).

Ford Motor Company, "Navigation System: SYNC," Owner's Guide Supplement, SYNC Version 2 (Oct. 2008).

Ford Motor Company, "Navigation System: SYNC," Owner's Guide Supplement, SYNC Version 3 (Jul. 2009).

Ford Motor Company, "SYNC," Owner's Guide Supplement, SYNC Version 1 (Nov. 2007).

Ford Motor Company, "SYNC," Owner's Guide Supplement, SYNC Version 2 (Oct. 2008).

Ford Motor Company, "SYNC," Owner's Guide Supplement, SYNC Version 3 (Aug. 2009).

Voelcker, Top 10 Tech Cars It's the Environment, Stupid, www.Spectrum IEEE.Org, Apr. 2008, pp. 26-35.

Wikipedia, the free encyclopedia, X Window System, http://en.wikipedia.org/wiki/X_Window_System, Jun. 22 2010.

Yarden, et al., Tuki: A Voice-Activated Information Browser, IEEE, 2009, pp. 1-5.

Newmark, American, Concept Car, Ford, Gadgets, Lifestyle. Technology, Student develop in-car cloud computing apps; envision the future of in-car connectivity, May 4, 2010, http:/www.worldcarfans.com/print/110050425986/student-develop-in-car-cloud-cmputing_apps;_envision_the_future_of_in-car_connectivity.

International Searching Authority, United States Patent and Trademark Office, International Search Report for PCT Application No. PCT/US2010/37052 mailed Sep. 17, 2010.

International Bureau of WIPO, Advance E-Mail Notification and Transmittal of International Preliminary Report on Patentability for PCT Application No. PCT/US2011/053342 e-mailed Apr. 11, 2013.

* cited by examiner

SYSTEM AND METHOD FOR PROVIDING CUSTOMIZED AUDIO CONTENT TO A VEHICLE RADIO SYSTEM USING A SMARTPHONE

CROSS-REFERENCE TO RELATED APPLICATIONS

This application claims the benefit of U.S. Provisional Application No. 61/820,920, filed on May 8, 2013. The entire disclosure of the above application is incorporated herein by reference.

FIELD

The present disclosure relates to systems and methods for providing customized audio content to a vehicle radio system, and more particularly to a system and method for providing customized audio content, at a user's command, to a vehicle radio system that is connected to the cloud through the user's smartphone.

BACKGROUND

The statements in this section merely provide background information related to the present disclosure and may not constitute prior art.

Smartphone usage has become widespread, and continues to grow. Presently smartphones are popular for use in obtaining information content from the Internet, as well as accessing email accounts. Most present day OEM motor vehicle manufacturers also equip their vehicles with radio systems that are able to wirelessly interface with a user's smartphone. This enables the vehicle radio system to be used as a wireless speakerphone or as a device to play back streamed audio content being received via the smartphone.

Presently there is no known easy and convenient way for a user to obtain real time audio information from the Cloud via a simple command from the vehicle radio system. It will be appreciated that the Cloud may be considered to be, without limitation, any remotely wirelessly accessible (e.g., via the Internet) software or hardware service, and particularly any remotely available information, music, social networking/media site, any traffic or weather data service, or and other data service. For example, at the present time a user who wishes to obtain real time weather or traffic information would need to access his or smartphone and obtain the information while manipulating controls of the smartphone. This is undesirable for an individual who is in the process of operating a motor vehicle. There is always the option of the user pulling off of a road or highway, and then using the smartphone to obtain the desired content, but it will be appreciated that this can represent a significant inconvenience to the user. Furthermore, in some instances such as while travelling on a freeway through a metropolitan area, it may not be feasible or desirable to pull off the freeway to an area where the vehicle can be parked.

At the present time, for the above described scenario where the user wishes to obtain immediate real time weather or traffic information, the user would still need to focus on reading information on the display of either the smartphone or the display of the vehicle radio system. Again, this is undesirable as it requires the user to divert her/his attention from watching the road and operating her/his vehicle.

SUMMARY

In one aspect the present disclosure relates to a method for providing real time content from a remote content source to an individual travelling in a vehicle. The method may include receiving information from a user by which the user selects a specific, remote content source from which information may be obtained at least substantially in real time when the user is travelling in the vehicle. A control may be designated which is associated with a user accessible subsystem of the vehicle, and which is operative to initiate obtaining the information from the remote content source when the control is accessed by the individual. The method may further include using a short range wireless transceiver on the vehicle to establish a short range, wireless communications, link with a personal electronic device (PED) associated with the individual, which is present on the vehicle with the individual. A first signal may be generated, when the control is accessed, which is generated from the user accessible subsystem of the vehicle, and received by the PED. The PED may be used to generate a second signal when the first signal is received. The second signal may be used to access a Cloud based connection subsystem, with the second signal identifying the individual to the Cloud based connection subsystem. The Cloud based connection subsystem may be used to access the remote content source to obtain the information. The information may then be streamed back to the user accessible subsystem via the Cloud based connection subsystem and the PED, at least substantially in real time, for playback to the individual over the user accessible subsystem while the individual is travelling in the vehicle.

In another aspect the present disclosure relates to a method for providing real time content from a remote content source to an individual traveling in a vehicle. The method may include receiving information from a user by which the user selects a specific, remote content source from which information may be obtained at least substantially in real time when the individual is travelling in the vehicle. The method may also involve designating a control associated with a radio system of the vehicle as being operative to initiate obtaining the information from the remote content source when the control is accessed by the individual. A short range wireless transceiver on the vehicle may be used to establish a short range, wireless communications link with a personal electronic device (PED) associated with the individual, which is present on the vehicle with the individual. A first signal may be generated when the control is accessed, which is generated from the user accessible subsystem of the vehicle, and received by the PED. The PED may be used to generate a second signal when the first signal is received, and where the second signal is used to access a Cloud based connection server. The Cloud based connection server may be used to access a plurality of predetermined, Cloud based information sources for obtaining predetermined sponsorship information and predetermined information content. The predetermined sponsorship and content information may then be streamed back to the individual accessible subsystem via the Cloud based connection subsystem and the PED, at least substantially in real time, for playback on the radio system while the individual is travelling in the vehicle.

In still another aspect the present disclosure relates to a system for providing real time audio content from a remote content source, over an audio system of a vehicle, to an individual travelling in the vehicle. The system may include a personal electronic device (PED) for receiving a wireless first signal from the audio system when a control of the audio system is selected by the individual. The PED may include a processor having non-transitory machine executable code running thereon and configured to generate a second wireless signal, when the first signal is received, to access a Cloud based connection subsystem. The second signal identifies the individual to the Cloud based connection subsystem. The identification enables predetermined information content for the individual to be identified. The PED also receives information content, at least substantially in real time, obtained by the Cloud based connection subsystem from at least one Cloud based information service. The PED is further configured to provide the information content to the audio system for play back while the individual is travelling in the vehicle.

BRIEF DESCRIPTION OF THE DRAWINGS

The drawings described herein are for illustration purposes only and are not intended to limit the scope of the present disclosure in any way.

DETAILED DESCRIPTION

Figure 1:
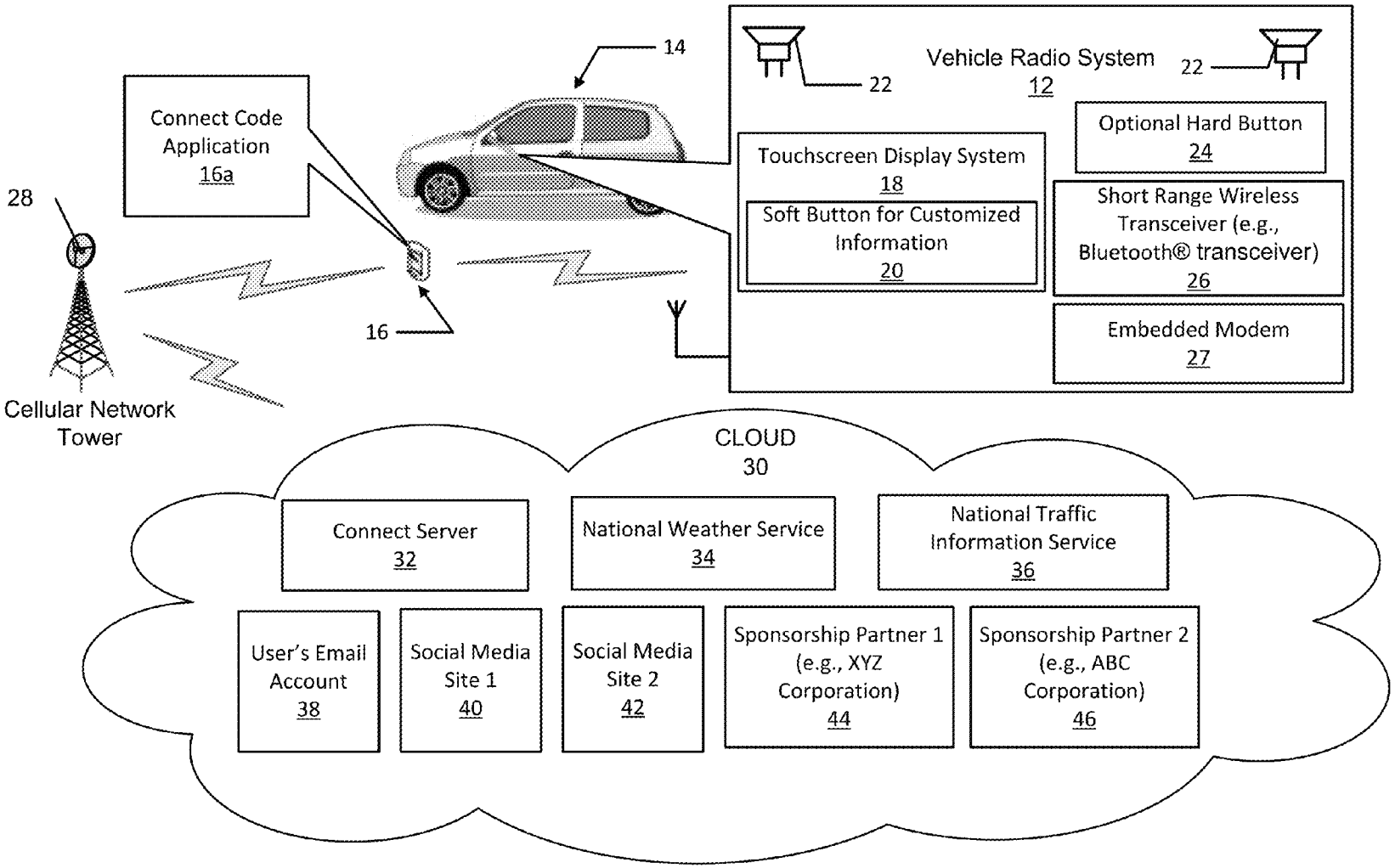
FIG. 1 is a high level block diagram of a system in accordance with one embodiment of the present disclosure for providing customized audio content to a vehicle radio system via a user's smartphone.

The following description is merely exemplary in nature and is not intended to limit the present disclosure, application, or uses. It should be understood that throughout the drawings, corresponding reference numerals indicate like or corresponding parts and features.

Referring to FIG. 1 there is shown a system 10 in accordance with one embodiment of the present disclosure. The system 10 may make use of an audio system in the form of a vehicle radio system 12 of a motor vehicle 14, and a user's smartphone 16 that is present in the vehicle. The radio system 12 may have a display screen, in this example a touchscreen display 18 upon which a "soft" button 20 may be displayed. The soft button 20 may be used to enable a user to select customized audio content to be delivered to the radio system 12 for playback over a plurality of speakers 22 of the radio system 12. Instead of the soft button 20, the radio system 12 may have a "hard" button 24, which is a dedicated, physical button or control that the user may access to select customized audio content. As such, both soft and hard buttons are contemplated for use by the present disclosure.

The system 10 may further include a short range wireless transceiver 26, for example a Bluetooth® wireless protocol transceiver, for making a short range wireless connection with the user's smartphone 16. It will be appreciated that the smartphone 16 also includes a short range wireless transceiver (not shown) which operates in accordance with the same protocol of the short range transceiver 26. This enables a wireless connection to be made between the smartphone 16 and the radio system 12 almost immediately upon the user entering the vehicle 14 while carrying the smartphone. Also, an embedded modem 27 could be included in the vehicle 14. Thus, it will be appreciated that there is a data connection to the vehicle's 14 electronics, whether it be by the smartphone, by an embedded modem, or other form of WiFi connection. For the purpose of simplicity and providing one example, but without limitation, the following discussion will focus on the smartphone 16 providing the data connection to the vehicle 14.

The smartphone 16 may be in wireless communication with a cellular network tower 28 associated the user's cellular network provider. The smartphone 16 may have a "connect" code application that facilitates connection and communication with a remotely located subsystem (e.g., server) for the purpose of streaming content provided by the remote subsystem. The cellular network tower 28 may be used by the smartphone 16 to access various systems and/or entities present in the Cloud 30.

In FIG. 1 a plurality of different entities are shown present in the Cloud 30. In this example a "connect" server 32 is accessible by the smartphone 16. The connect server 32 may be operated or associated with the vehicle 14 manufacturer or a third party, and acts as an intermediary to obtain real time streaming information from other sources. In this example various other Cloud-based information content sources are shown as a National Weather Service 34, a National Traffic Information Service 36, the user's email account 38 (e.g., Gmail®, Yahoo® Mail, etc.), a first social media site 40 (e.g., Facebook®), a second social media site (e.g., Twitter®) 42, a first sponsorship partner site (e.g., XYZ company) 44 and a second sponsorship site 46 (e.g., ABC company). However, it will be appreciated that virtually any number of different entities could be present in the Cloud 30 and those shown in FIG. 1 are only intended to illustrate a small number of the different types that could be accessed for information content by the connect server 32.

The first and second sponsorship partners 44 may each be entities that have previously entered into an agreement with the manufacturer of the vehicle 14 to sponsor various content (e.g., customized traffic or weather information) which may be accessed by the user, and where a fee imposed on the user would otherwise be required if not for the sponsorship agreement(s). It is an important advantage that the content obtained by the connect server 32 and supplied to the smartphone is customized, streamed audio content that is able to be played over the radio system 12 of the vehicle 14. By "customized" it is meant information that the user has selected during a previously performed programming or setup. For example, upon purchasing the vehicle 14 the user may be able initiate a programming operation using the vehicle's own radio system 12 to select a specific information content source that the user may obtain real time audio information content from. Alternatively it is possible that this initial programming may be performed using both the vehicle radio system 12 and the user's smartphone 16. It is also possible that the user may be required to contact the selected information content source by email or other means and to register as a user with the content source. The initial programming will set the soft button 20 to use the smartphone 16 to initiate contact with the programmed remote content source whenever the user selects it.

Figure 2:
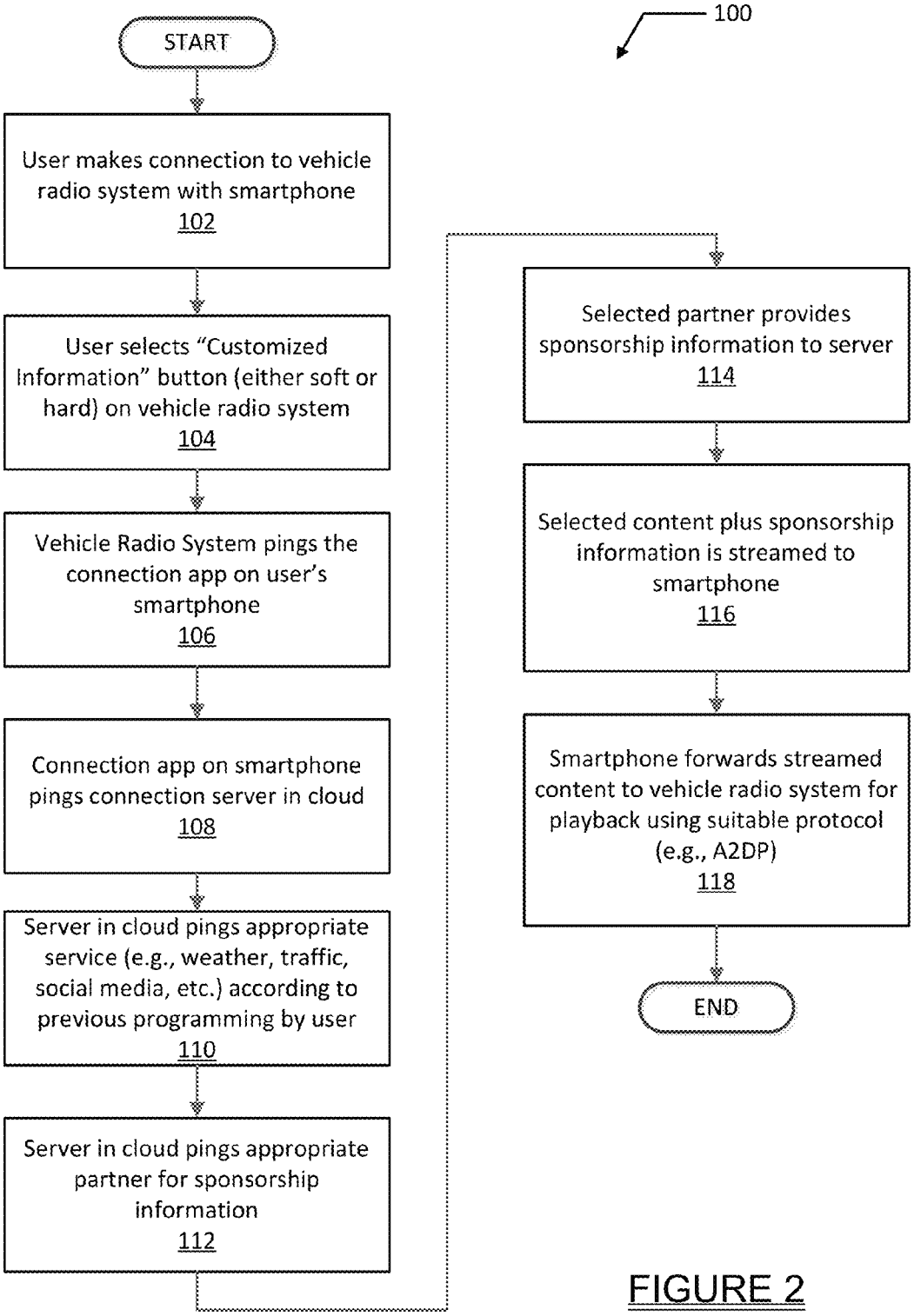
FIG. 2 a flowchart illustrating operations that may be performed using the system of FIG. 1 to deliver customized audio content to a user's vehicle radio system via the user's smartphone.

Referring now to FIG. 2, a flowchart 100 illustrates one example of various operations that may be performed by the system 10 as it is used to provide customized real time streaming audio content to the user. For the discussion of FIG. 2 is will be assume that the programming of the soft button 20 has already been performed by the user.

At operation 102 the user initially makes a wireless connection to the vehicle radio system 12 with her/his smartphone 16 when the user enters the vehicle while carrying the smartphone. This may happen automatically via the short range wireless transceiver 26 in the radio system 12 and the similar transceiver carried within the smartphone 16, within moments of the user entering the vehicle 14.

At operation 104 the user may select the soft button 20. Alternatively, if the radio system 12 incorporates the hard button 24 instead, then the user would select the hard button. For the purpose of discussion it will be assumed that the radio system 12 incorporates the soft button 20.

At operation 106 the vehicle radio system 12 pings the connection application **16*a* on the smartphone 16 to signal the application 16***a* that the user has requested the customized information content via a selection of the soft button 20. At operation 108 the smartphone 16 pings the connection server 32 in the cloud 30 to notify it that information content has been requested. The connection server 32 is provided with information during the initial programming sequence described above that it uses to identify the specific user that is making the request, and the specific type of information content that needs to be obtained for the user, and then pings the appropriate service, as indicated at operation 110. The server 32 then pings the appropriate sponsorship partner (i.e., servers associated with Partner 1 or Partner 2 in FIG. 1) for sponsorship information associated with the requested information content, as indicated at operation 112.

At operation 114 the selected sponsorship partner provides sponsorship information to the connection server 32. The sponsorship information may be a short audio segment (e.g., "This update being brought to you by XYZ Corporation, a leader in wireless technology"). At operation 116 the selected information content plus the sponsorship information is streamed to the smartphone 16. At operation 118 a suitable protocol is used to stream the information content received by the smartphone 16 to the radio system 12. Any suitable protocol may be used, but in one example the protocol used may be the "Advanced Audio Distribution Profile ("A2DP"), which is a Bluetooth® profile that allows for wireless transmission of stereo audio from an A2DP source. The streamed content is played as audio content over the vehicle's radio system 12. If the streamed content is from the National Weather Service 34 it may comprise audio content providing a real time weather update for the user's location. In this regard it will be appreciated that navigation information could be supplied by a navigation system on the smartphone 16 or from a navigation system on the vehicle 14, which the National Weather Service 34 entity may use to tailor the delivery of content so that it coincides with the user's real time location when travelling in the vehicle 14. If the user's email account 38 is programmed as the selection for the soft button 20, then an audio clip reciting new messages received in the Inbox of the user's email account may be played back over the radio system 12. Likewise, information received on the user's account for the social media sites 1 and 2 (entities 40 and 42 in FIG. 1) may be played back in the form of an audio clip on the radio system 12 via suitable and commercially available "text to speech" ("TTS") technology. It is a principal advantage that the user is presented with audio content which is played over the speakers 22 of the radio system 12, rather than text or graphics on the smartphone 16 that the user would need to read and digest. This allows the user to keep her/his focus on the road while listening to the audio content being delivered. The one touch selection afforded by the soft button 20 allows the user to easily and conveniently request the real time information content without having to handle and manipulate any of the controls on her/his smartphone 16 while operating the vehicle 14. The system 10 thus provides a significant convenience to the user and makes important real time audio information available at the touch of a button.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A method for providing real time content from a remote content source to an individual travelling in a vehicle, the method including:

receiving programming information from an individual during a programming operation by which the individual provides first and second types of information, the first type of information including identification information uniquely identifying the individual, and the second type of information including content selection information by which the individual selects a specific, remote content source from a plurality of available content sources to obtain information content from, which said information content may be obtained at least substantially in real time when the individual is travelling in the vehicle;

receiving a selection from the individual by which the individual is able to designate a specific control of the user accessible subsystem as being operative to initiate obtaining the information content from the remote content source when the control is accessed by the individual;

using a short range wireless transceiver on the vehicle to establish a short range, wireless communications link with a personal electronic device (PED) associated with the individual, which is present on the vehicle with the user;

generating a first signal, when the control is accessed by the individual, which is generated from the user accessible subsystem of the vehicle, and received by the PED;

using the PED to generate a second signal when the first signal is received;

using the second signal to access a Cloud based connection subsystem, the second signal identifying the individual to the Cloud based connection subsystem;

using the Cloud based connection subsystem to determine a specific remote sponsorship partner to be contacted for sponsorship content;

using the Cloud based connection subsystem to access the remote content source previously selected by the individual during the programming operation, to obtain the information content; and streaming the information content and the sponsorship content back to the user accessible subsystem via the Cloud based connection subsystem and the PED, at least substantially in real time, for playback to the individual while the individual is travelling in the vehicle.

2. The method of claim 1, wherein designating a specific control associated with a user accessible subsystem of the vehicle comprises designating a soft button associated with a radio system of the vehicle, as being operative to initiate obtaining the information from the remote content source when the soft button is accessed by the individual.

3. The method of claim 1, wherein designating a specific control associated with a user accessible subsystem of the vehicle comprises designating a hard button associated with a radio system of the vehicle, as being operative to initiate obtaining the information from the remote content source when the hard button is accessed by the individual.

4. The method of claim 1, wherein generating a first signal when the control is accessed, which is generated from the user accessible subsystem of the vehicle, comprises generating a short range, wireless signal from a radio subsystem of the vehicle to the individual's PED informing that the specific control has been accessed by the individual.

5. The method of claim 1, wherein using the PED to generate a second signal when the first signal is received comprises using a smartphone to automatically generate, without user intervention, a request for the information content and the sponsorship content, which are transmitted wirelessly to a cellular network with which the individual is associated with.

6. The method of claim 1, wherein using the second signal to access a Cloud based connection subsystem comprises using the second signal to access a Cloud based server.

7. The method of claim 1, wherein using the Cloud based connection subsystem to access the remote content source to obtain the information content comprises using a Cloud based server to determine, based on an identify of the individual and on a previous selection made by the individual, which one of the plurality of available different content sources to obtain the information content from.

8. The method of claim 7, wherein the available information content sources comprise at least a plurality of:

weather services;

traffic services;

the individual's email account; and a social media site.

9. The method of claim 1, wherein:

the operation of generating a first signal, when the specific control is accessed, which is generated from the user accessible subsystem of the vehicle and received by the PED, comprises using the first signal to ping a connection application stored on the PED; and wherein using the PED to generate the second signal comprises using the connection application to ping the Cloud based connection subsystem; and wherein pinging the Cloud based connection subsystem comprises pinging a Cloud based server.

10. The method of claim 9, further comprising using the PED to ping a Cloud based sponsorship server for the sponsorship content to be played back with the obtained information.

11. A method for providing real time content from a remote content source to an individual travelling in a vehicle, the method including:

receiving programming information from the individual by which the individual provides first and second types information, the first type of information being identifying information and the second type of information being a selection of one specific, remote content source from a plurality of available content sources from which to obtain information content, which said information content may be obtained at least substantially in real time when the individual is travelling in the vehicle;

designating a specific control associated with a radio system of the vehicle as being operative to initiate obtaining the information content from the remote content source when the specific control is accessed by the individual;

using a short range wireless transceiver on the vehicle to establish a short range, wireless communications link with a personal electronic device (PED) associated with the individual, which is present on the vehicle with the user;

generating a first signal, when the specific control is accessed, which is generated from the user accessible subsystem of the vehicle, and received by the PED;

using the PED to generate a second signal when the first signal is received;

using the second signal to access a Cloud based connection server;

using the Cloud based connection server to identify an identity of the individual and to access a plurality of predetermined, Cloud based information sources for obtaining predetermined sponsorship information and predetermined information content, based on the programming information; and streaming the predetermined sponsorship and information content back to the user accessible subsystem via the Cloud based connection subsystem and the PED, at least substantially in real time, for playback on the radio system while the individual is travelling in the vehicle.

12. The method of claim 11, wherein the designating a specific control on the radio system comprises designating at least one of a soft control and a hard control.

13. The method of claim 12, wherein a plurality of predetermined, Cloud based information sources comprise a sponsorship server and at least one of the following:

a traffic information service;

a weather information service;

an email account of the individual; and a social media site.

14. A system for providing real time audio content from a remote content source, over an audio system of a vehicle, to an individual travelling in the vehicle, the system including:

a personal electronic device (PED) for receiving a wireless first signal from the audio system when a specific control of the audio system, previously designated by the individual as being assigned to obtain predetermined information content from a remotely located predetermined content source, is selected by the individual, the PED having a processor having non-transitory machine executable code running thereon and configured to:

generate a second wireless signal, when the first signal is received, to access a Cloud based connection subsystem, the second signal identifying the individual to the Cloud based connection subsystem, the identification enabling the predetermined information content for the individual to be identified, based on a previously performed programming operation carried out by the individual wherein both identifying and content selection have been provided by the individual;

to receive information content, at least substantially in real time, obtained by the Cloud based connection subsystem from at least one Cloud based information service, along with sponsorship content obtained from an independent sponsorship content source; and to provide the information content and the sponsorship content to the audio system for play back while the individual is travelling in the vehicle.

15. The system of claim 14, wherein the Cloud based connection subsystem comprises a Cloud based server.

16. The system of claim 14, wherein the at least one Cloud based information service comprises at least one of a traffic information service;

a weather information service;

a social media site; and an email account of the individual.

* * * * *